US010342340B2

(12) United States Patent
Kassanoff et al.

(10) Patent No.: US 10,342,340 B2
(45) Date of Patent: Jul. 9, 2019

(54) MODULAR DESK SYSTEMS AND METHODS

(71) Applicant: Paragon Furniture, LP, Arlington, TX (US)

(72) Inventors: Richard Kassanoff, Dallas, TX (US); Robert Larry Stewart, Grapevine, TX (US)

(73) Assignee: Paragon Furniture, Inc., Arlington, TX (US)

( * ) Notice: Subject to any disclaimer, the term of this patent is extended or adjusted under 35 U.S.C. 154(b) by 0 days.

(21) Appl. No.: 14/984,103

(22) Filed: Dec. 30, 2015

(65) Prior Publication Data

US 2016/0106210 A1 Apr. 21, 2016

Related U.S. Application Data

(63) Continuation of application No. 14/069,168, filed on Oct. 31, 2013, now Pat. No. 9,226,579.

(60) Provisional application No. 61/767,672, filed on Feb. 21, 2013, provisional application No. 61/722,028, filed on Nov. 2, 2012.

(51) Int. Cl.

| | |
|---|---|
| ***A47B 87/00*** | (2006.01) |
| ***A47B 41/00*** | (2006.01) |
| ***A47B 17/06*** | (2006.01) |
| ***A47B 21/00*** | (2006.01) |
| ***A47B 41/04*** | (2006.01) |
| ***A47B 41/06*** | (2006.01) |

(52) U.S. Cl.

CPC ..... *A47B 87/002* (2013.01); *A47B 17/06* (2013.01); *A47B 21/00* (2013.01); *A47B 41/00* (2013.01); *A47B 41/04* (2013.01); *A47B 41/06* (2013.01); *A47B 2200/0001* (2013.01); *A47B 2200/0011* (2013.01); *A47B 2200/0084* (2013.01); *A47B 2220/0027* (2013.01); *A47B 2220/0061* (2013.01)

(58) Field of Classification Search

CPC ..... A47B 41/00; A47B 41/04; A47B 41/06; A47B 87/002; A47B 21/06; A47B 2021/062; A47B 2021/064; A47B 2021/066; A47B 2021/068; A47B 83/001; A47B 13/16; A47B 17/06

See application file for complete search history.

(56) References Cited

U.S. PATENT DOCUMENTS 2,794,695 A * 6/1957 Heal ..... A47B 9/08 108/146

4,067,606 A * 1/1978 Desmoulins nee Fouchereau ..... A47B 3/14 108/135

5,083,512 A * 1/1992 Newhouse ..... A47B 21/06 108/50.02

(Continued)

*Primary Examiner* — Hanh V Tran

(74) *Attorney, Agent, or Firm* — Ferguson Braswell Fraser Kubasta PC; Elizabeth Philip Dahm; Kelly J. Kubasta

(57) ABSTRACT

A modular desk system may include a plurality of configurable components including, for example, a top panel, an all-purpose hook, a cup hook, a storage shelf, a connecting shelf, a connecting planter box, a connecting divider, a connecting platform, a desktop organization member, a channel, a kickstand base, and/or a support frame. The components may be configured and/or reconfigured to create a desk. The configuration assemblies of the modular desk system may be paired with and coupled to other desk units and/or furniture.

21 Claims, 21 Drawing Sheets

(56) References Cited

U.S. PATENT DOCUMENTS 5,606,920 A * 3/1997 Meyer ..... A47B 17/00 108/50.02
5,752,449 A * 5/1998 Simon ..... A47B 9/00 108/153.1
5,878,673 A * 3/1999 Kramer ..... A47B 87/002 108/50.02
6,170,410 B1 * 1/2001 Gioacchini ..... A47B 87/002 108/153.1
6,336,414 B1 * 1/2002 Stewart ..... A47B 3/0815 108/115
6,604,784 B1 * 8/2003 Bosman ..... A47B 7/02 297/171
7,451,918 B2 * 11/2008 Vogt ..... G07F 19/20 235/379
7,757,612 B2 * 7/2010 Korber ..... A47B 21/00 108/25
8,312,820 B2 * 11/2012 Rotlevi ..... A47B 21/00 108/50.01
8,424,464 B2 * 4/2013 Korpi ..... A47B 23/044 108/27
2001/0013305 A1 * 8/2001 Funk ..... A47B 21/06 108/50.02
2003/0024447 A1 * 2/2003 Risdall ..... A47B 91/00 108/153.1
2003/0037709 A1 * 2/2003 Kolavo ..... A47B 21/0073 108/50.01
2004/0035332 A1 * 2/2004 Lin ..... A47B 21/0314 108/50.01
2005/0179348 A1 * 8/2005 Caveney ..... H04Q 1/064 312/248
2005/0223952 A1 * 10/2005 Brewer ..... A47J 37/1271 108/152
2006/0081157 A1 * 4/2006 Gayhart ..... A47B 21/06 108/50.02
2007/0000414 A1 * 1/2007 Riddiford ..... A47B 21/00 108/50.01
2007/0022918 A1 * 2/2007 Sweet ..... A47B 21/06 108/50.02
2007/0045485 A1 * 3/2007 Nichols ..... A47B 9/20 248/118
2010/0224105 A1 * 9/2010 Abel ..... A47B 7/02 108/91
2011/0075337 A1 * 3/2011 Riley ..... A47B 21/0073 361/679.2
2011/0101195 A1 * 5/2011 Skolnik ..... A47B 23/04 248/446
2011/0219991 A1 * 9/2011 Abel ..... A47B 7/02 108/42
2011/0297052 A1 * 12/2011 Martin ..... A47B 13/003 108/27
2011/0297056 A1 * 12/2011 Martin ..... A47B 3/06 108/152
2014/0124641 A1 * 5/2014 Kassanoff ..... A47B 17/04 248/447

* cited by examiner

MODULAR DESK SYSTEMS AND METHODS

CROSS REFERENCE TO RELATED APPLICATIONS

This application is a continuation of U.S. patent application Ser. No. 14/069,168 filed on Oct. 31, 2013, which issues as U.S. Pat. No. 9,226,579 on Jan. 5, 2016, and which claims the benefit under 35 U.S.C. § 119(e) of U.S. Provisional Patent Application Ser. No. 61/767,672 filed on Feb. 21, 2013, entitled "Modular Desk Systems," and U.S. Provisional Patent Application Ser. No. 61/722,028 filed on Nov. 2, 2012, entitled "Modular Desk Systems," all of which is incorporated by reference in its entirety.

FIELD OF THE DISCLOSURE

The present disclosure relates generally to modular furniture and, in particular, to modular desk systems and methods.

BACKGROUND

Conventional desk systems typically have a fixed construction that inhibits adaptability to various uses, and such systems are generally standalone units that cannot readily pair with or couple to other desk units or furniture. Moreover, conventional desk systems typically comprise standard, flat desktops of limited space, having a leg supporting each corner of the desktop.

SUMMARY

Embodiments of the present disclosure generally provide modular desk systems comprising a plurality of components that may include, but are not limited to, a top panel, an all-purpose hook, a cup hook, a storage shelf, a connecting shelf, a connecting planter box, a connecting divider, a connecting platform, a desktop organization member, a channel, a kickstand base, a support frame, or any combination thereof.

Embodiments of the present disclosure further provide methods of assembling modular desk system components into configuration assemblies for a variety of different uses, including, for example, providing a work space, a reading space, a writing space, a space for use in conjunction with educational study, storing objects, displaying items, organizing, supporting and displaying electronic media, pairing with and coupling a configuration assembly to other desk units and/or furniture, or any combination thereof.

Embodiments of the present disclosure may provide a first linked desk system including a support frame comprising a pair of C-shaped spine members coupled through a kickstand base, a top panel having a lip sealed thereto, a storage shelf, and a desktop organization and display stand system. The kickstand base may include stoppers to engage the kickstand base with a floor surface. The C-shaped spine members may include footcaps to engage the C-shaped spine members with a floor surface. The first linked desk system may further include at least one accessory hook, wherein the accessory hook is selected from the group including an all-purpose hook and a cup hook. The first linked desk system may further include a channel coupled to the support frame to store, route, secure or otherwise organize wires, cables, and other electronic media.

The desktop organization and display stand system may include a housing coupled to a portion of the first linked desk system, the housing having a central opening, the portion of the first linked desk system selected from the group including the support frame and the top panel, a top panel coupled to the housing at a pivot point such that the top panel is flippable between a closed position and an open position, at least one ledge member coupled to an inner surface of the housing, and a nest coupled to the housing capable of securing and storing electronic devices, books, and other objects. The top panel may include ridges to retain objects when the top panel is in the closed position. The top panel may be flush against an upper surface of the housing when the top panel is in the closed position, and the top panel may lean against the housing when the top panel is in the open position, such that the top panel and the at least one ledge member form a display stand.

Embodiments of the present disclosure may provide a modular desk assembly including a first linked desk system, a second linked desk system, and a connection device therebetween. The first linked desk system may include a first support frame comprising a pair of C-shaped spine members coupled through a kickstand base, a first top panel having a lip sealed thereto, a first storage shelf, and a first desktop organization and display stand system. The second linked desk system may include a second support frame comprising a pair of C-shaped spine members coupled through a kickstand base, a second top panel having a lip sealed thereto, a second storage shelf, and a second desktop organization and display stand system. The connection device may be selected from the group including a connecting shelf, a connecting planter box, a connecting divider, and a connecting platform. The kickstand base of both the first linked desk system and the second linked desk system may further include stoppers to engage each kickstand base with a floor surface. Each of the first linked desk system and the second linked desk system may further include footcaps to engage the C-shaped spine members with a floor surface.

Each of the first desktop organization and display stand system and the second desktop organization and display stand system may include a housing coupled to a portion of the first linked desk system, the housing having a central opening, the portion of the first linked desk system selected from the group including the support frame and the top panel, a top panel coupled to the housing at a pivot point such that the top panel may be flippable between a closed position and an open position, at least one ledge member coupled to an inner surface of the housing and a nest coupled to the housing capable of securing and storing electronic devices, books, and other objects.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Embodiments of the present disclosure generally provide a modular desk system comprising a plurality of configurable components and methods of forming configuration assemblies from such components. In certain embodiments, the present disclosure may provide modular desk systems configured for pairing with and coupling to other desk units and/or furniture.

FIGS. 1-5 illustrate representative configurations 100*a*, 100*b*, 100*c*, 100*d*, 100*e* and 100*f* of a modular desk system and components thereof. A modular desk system may comprise a plurality of components assembled to form configurations 100*a*, 100*b*, 100*c*, 100*d*, 100*e* and 100*f*. It should be understood that the components of a modular desk system forming the configurations 100*a*, 100*b*, 100*c*, 100*d*, 100*e*, 100*f* and parts thereof shown in FIGS. 1-5 are for illustrative purposes only, and that any other suitable components or subcomponents may be used in conjunction with or in lieu of the components comprising a modular desk system and parts thereof.

The components of a modular desk system may generally comprise one or more of top panel, all-purpose hook, cup hook, storage shelf, connecting shelf, connecting planter box, connecting divider, connecting platform, desktop organization member, channel, kickstand base, support frame member, other suitable components, or any combination thereof according to embodiments of the present disclosure. The components of a modular desk system may be customized, reconfigured, or adjusted to provide a certain size, shape, configuration, position, purpose, utility, decorative look, other suitable disposition, or any combination thereof.

Figure 1A:
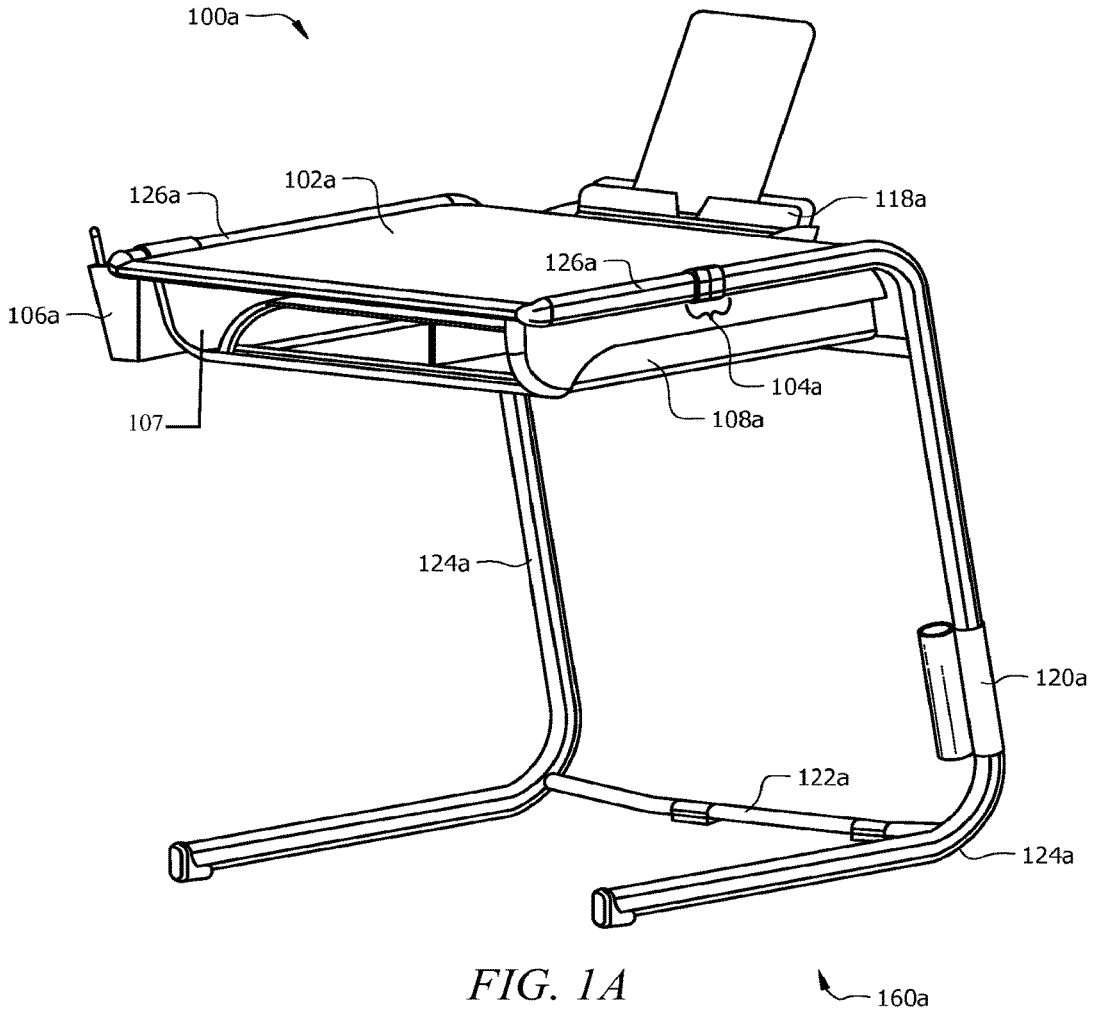
FIGS. 1A and 1B are perspective views of a system of modular desk components arranged in a first and second representative configuration according to embodiments of the present disclosure.

Referring now to FIG. 1A, a representative configuration 100*a* of components of a modular desk system is illustrated. Configuration 100*a* generally may comprise an assembly of modular components 160*a* (herein referred to as assembly 160*a*), according to embodiments of the present disclosure.

Assembly 160*a* may include top panel 102*a*, all-purpose hook 104*a*, cup hook 106*a*, a storage box 107, storage shelf 108*a*, desktop organization member 118*a*, channel 120*a*, and kickstand base 122*a*, all coupled to support, frame 124*a*.

Top panel 102*a* may comprise a solid, flat surface inset within support frame 124*a*. In embodiments of the present disclosure, top panel 102*a* may be employed as a desk surface, writing surface, a workspace, a surface used in conjunction with educational study, a reading platform, a display platform, a media display and organization space, an organization platform, other suitable uses, or any combination thereof.

In embodiments of the present disclosure, all-purpose hook 104*a* may be employed to retain or otherwise support personal items such as book bags, handbags, computer bags, laptop bags, hats, coats, jackets, outerwear, scarves, other suitable personal items, or any combination thereof.

Cup hook 106*a* may be employed to retain or otherwise support objects such as pens, pencils, highlighters, styli, writing instruments, other working instruments, water bottles, soda bottles, coffee cups, other suitable drinkware, snack bags, other suitable items, or any combination thereof according to embodiments of the present disclosure.

In embodiments of the present disclosure, all-purpose hook 104*a* and cup hook 106*a* may be connected or otherwise coupled to support frame 124*a* in any suitable manner, such as, for example employing an s-hook to engage spine 126*a* of support frame 124*a*, as shown in FIG. 1A. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, storage shelf 108*a* may be used to generally provide a full or partial enclosure. Storage shelf 108*a* may include any suitable pocket, storage area, surface, platform, plane, shelf, drawer, compartment, accessory, electrical outlet, telecommunications-related outlet, Ethernet outlet, WAN outlet, satellite outlet, cable outlet, audio/visual outlet, wire management system, other suitable housings, connections, outlets, or areas, or any combination thereof. In alternative embodiments, storage shelf 108*a* may further include a cover and locking mechanism to secure and lock an object in storage shelf 108*a*. Such a cover and locking mechanism may be any suitable size, shape, or configuration.

Assembly 160*a* may further include a desktop organization member 118*a*. In embodiments of the present disclosure, desktop organization member 118*a* may be employed to increase the efficiency of useable surface area of system 100*a*.

In one embodiment, desktop organization member 118*a* may be coupled to support frame 124*a*, as shown in FIG. 1A. In other embodiments, desktop organization member 118*a* may be integrated into top panel 102*a*. In alternative embodiments of the present disclosure, desktop organization member 118 may be coupled to the edge of system 100*a*, rather than being integrally constructed with system 100*a*.

In an engaged position, desktop organization member 118*a* may generally comprise a ledge and supporting wall which may be employed to support and display, for example, a tablet computer, as shown in FIG. 1A, a laptop computer, smart phone, electronic display, flat panel monitor, a television screen, liquid crystal display (LCD) screen, plasma screen, high definition television (HDTV) screen, projection television screen, computer screen, video conferencing display, other suitable devices, connections, outlets, or areas, or any combination thereof. Desktop organization member 118 may also be employed to support and display books, magazines, documents, other printed material, records, compact discs, collectable paraphernalia, personal items, a marker board, magnetic board, chalk board, tack board, sticker board, design board, other suitable uses, or any combination thereof.

In a disengaged position, desktop organization member 118*a* may comprise a top surface consistent with top panel 102*a*, or alternatively may have grooves or ridges that may be used to store pens, pencils, markers, other writing instruments, styli, other working instruments, other suitable objects, or any combination thereof.

Desktop organization member 118*a* may also comprise a nest which may house or otherwise retain a tablet computer, a laptop computer, smart phone, electronic display, flat panel monitor, a television screen, liquid crystal display (LCD) screen, plasma screen, high definition television (HDTV) screen, projection television screen, computer screen, video conferencing display, other suitable devices, connections, outlets, or areas, books, magazines, documents, other printed material, records, compact discs, collectable paraphernalia, personal items, a marker board, magnetic board, chalk board, tack board, sticker board, design board, other suitable items, or any combination thereof when not in use.

Channel 120*a* may comprise any suitably shaped, sized, or configured area and may be employed to store, route, secure, or otherwise organize wires, cables, and other electronic devices according to embodiments of the present disclosure. In embodiments of the present disclosure, channel 120 may be used to organize wire or cables associated with a laptop, computer, central processing unit (CPU), monitor, terminal, television, electronic display, external drive, storage device, computer accessory, lighting system, circuit breaker, electrical outlet, telecommunications-related outlet, Ethernet outlet, wide area network (WAN) outlet, satellite outlet, cable outlet, audio/visual outlet, wire management system, other suitable devices, objects, connections, outlets, or areas, or any combination thereof.

Figure 1B:
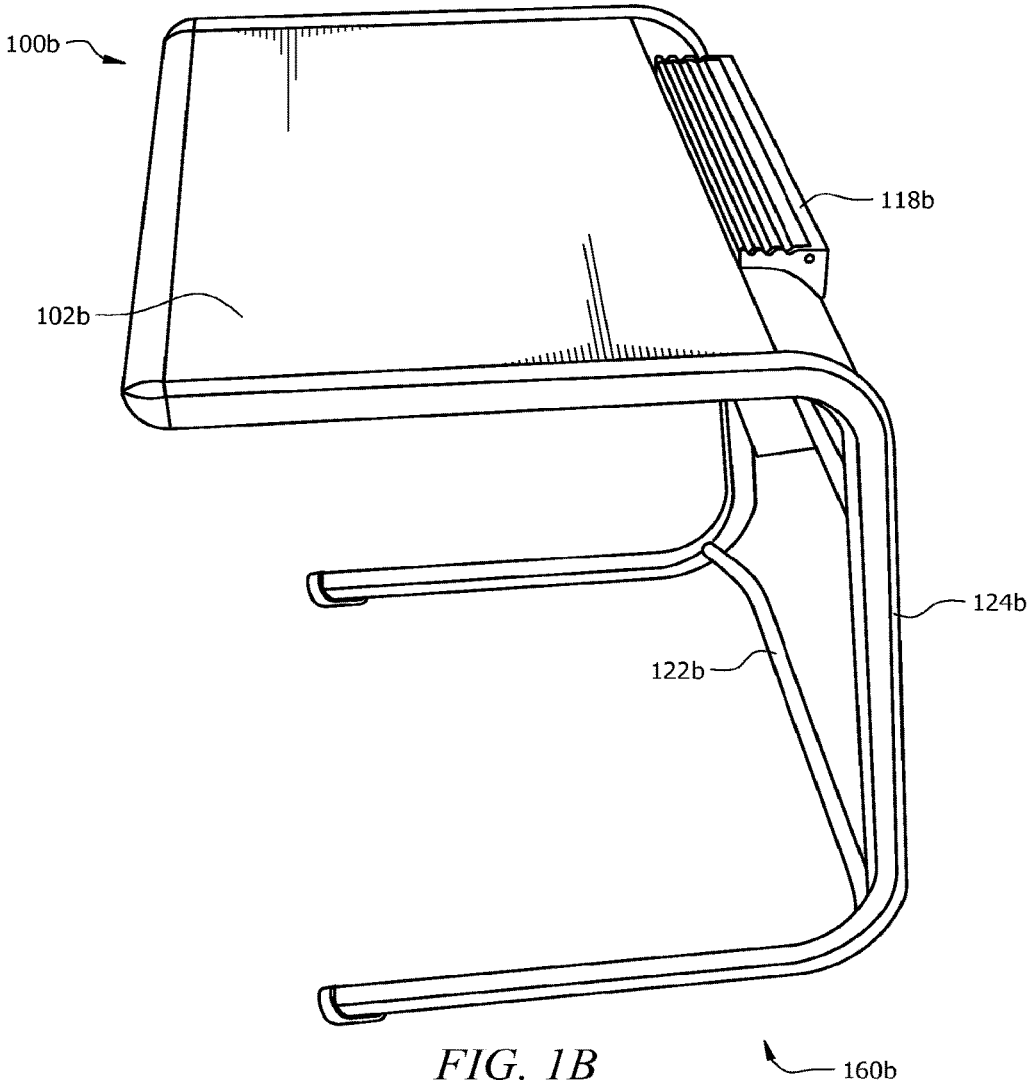

FIG. 1B is a perspective view of another representative configuration 100*b* of components of a modular desk system comprising a second assembly of modular components 160*b* (herein referred to as assembly 160*b*).

Assembly 160*b* may include top panel 102*b*, desktop organization member 118*b* and kickstand base 122*b*, all coupled to support frame 124*b*.

Two or more configuration assemblies of modular desk systems may be oriented next to each other, across from each other or engaging one another in other suitable patterns to create a continuous look among the plurality of assemblies, as exemplified in FIGS. 2-5.

Figure 2:
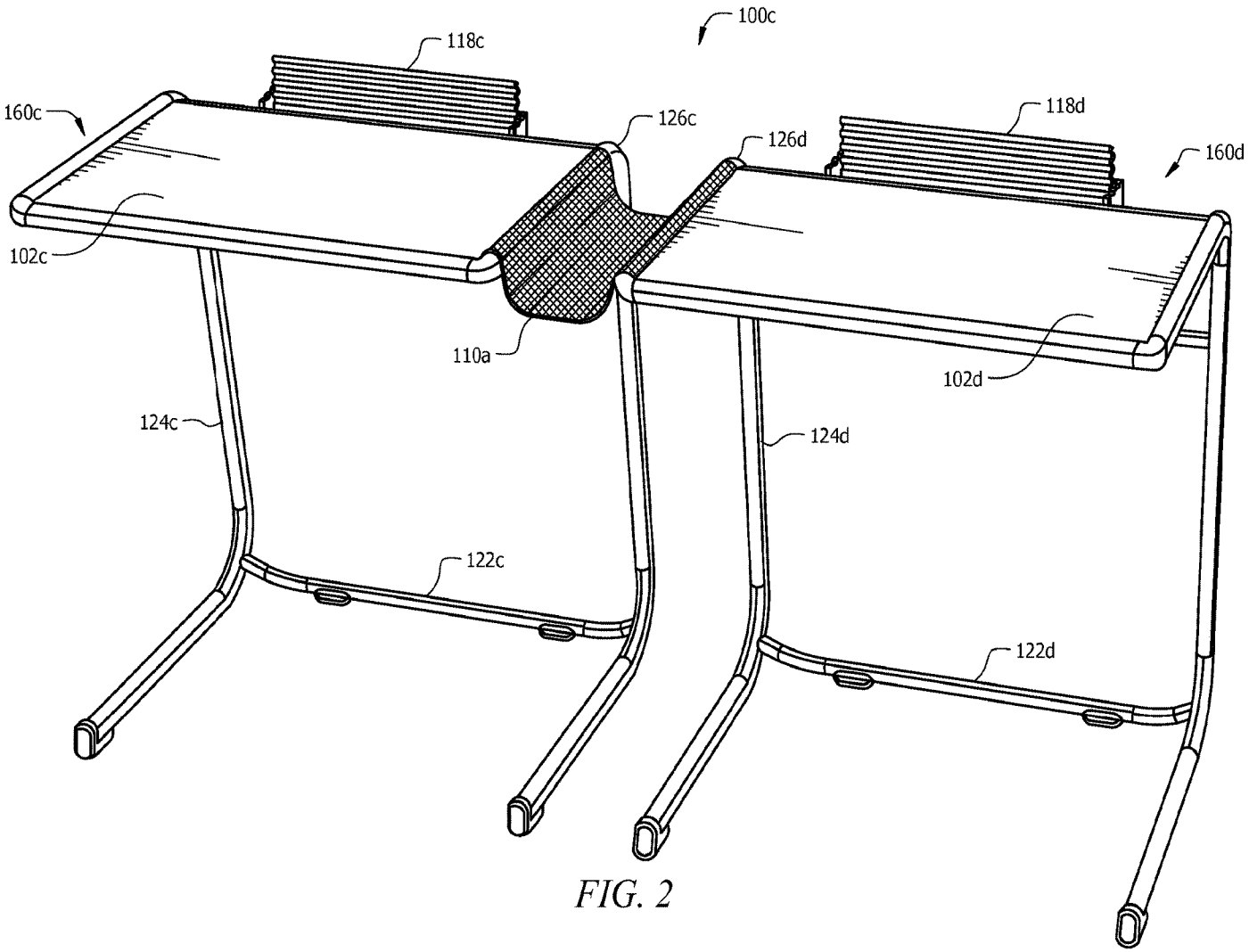
FIG. 2 is a perspective view of a system of modular desk components arranged in a third representative configuration according to embodiments of the present disclosure.

FIG. 2 is a perspective view of another representative configuration 100*c* of components of a modular desk system comprising a first assembly of modular components 160*c* (herein referred to as assembly 160*c*) and a second assembly of modular components 160*d* (herein referred to as assembly 160*d*), according to embodiments of the present disclosure.

Assembly 160*c* may include top panel 102*c*, desktop organization member 118*c* and kickstand base 122*c* coupled to a support frame 124*c*. Assembly 160*d* may include top panel 102*d*, desktop organization member 118*d* and kickstand base 122*d* coupled to support frame 124*d*. Assemblies 160*c* and 160*d* may or may not be coupled according to embodiments of the present disclosure. In an embodiment where assemblies 160*c* and 160*d* are coupled, configuration 100*c* may include connecting shelf 110*a* as shown in FIG. 2.

In an embodiment, each end of connecting shelf 110*a* may be connected or otherwise coupled to support frame 124*c* and support frame 124*d*, respectively, in any suitable manner, such as, for example employing an s-hook to engage spine 126*c* of support frame 124*c* and spine 126*d* of support frame 124*d*, as shown in FIG. 2. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting shelf 110*a* may comprise a solid, flat surface. Connecting shelf 110*a* may be employed as an additional writing surface, a workspace, a surface used in conjunction with educational study, a reading platform, a display platform, a media display and organization space, an organization platform, other suitable uses, or any combination thereof that may be shared between coupled assemblies.

Figure 3:
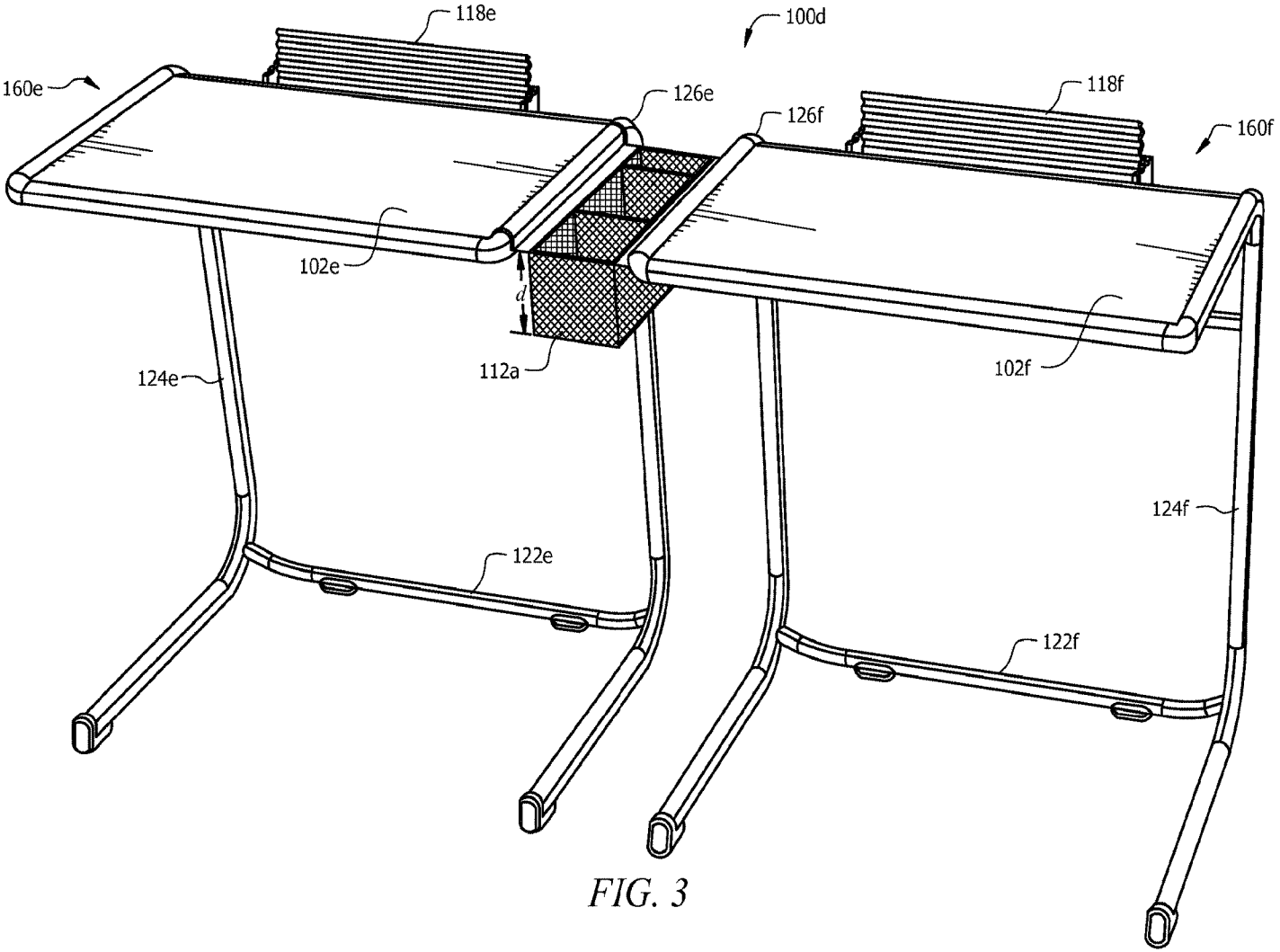
FIG. 3 is a perspective view of a system of modular desk components arranged in a fourth representative configuration according to embodiments of the present disclosure.

FIG. 3 is a perspective view of another representative configuration 100*d* of components of a modular desk system comprising a first assembly of modular components 160*e* (herein referred to as assembly 160*e*) and a second assembly of modular components 160*f* (herein referred to as assembly 160*f*), according to embodiments of the present disclosure.

Assembly 160*e* may include top panel 102*e*, desktop organization member 118*e* and kickstand base 122*e* coupled to support frame 124*e*. Assembly 160*f* may include top panel 102*f*, desktop organization member 118*f* and kickstand base 122*f* coupled to support frame 124*f*. Assemblies 160*e* and 160*f* may or may not be coupled according to embodiments of the present disclosure. In an embodiment where assemblies 160*e* and 160*f* are coupled, configuration 100*d* may include connecting planter box 112*a* as shown in FIG. 3.

In an embodiment, each end of connecting planter box 112*a* may be connected or otherwise coupled to support frame 124*e* and support frame 124*f*, respectively, in any suitable manner, such as, for example employing an s-hook to engage spine 126*e* of support frame 124*e* and spine 126*f* of support frame 124*f*, as shown in FIG. 3. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting planter box 112*a* may comprise a box having a depth (d). Connecting planter box 112*a* may be employed as planter box, a storage space, an organization space, other suitable uses, or any combination thereof that may be shared between coupled assemblies.

Figure 4:
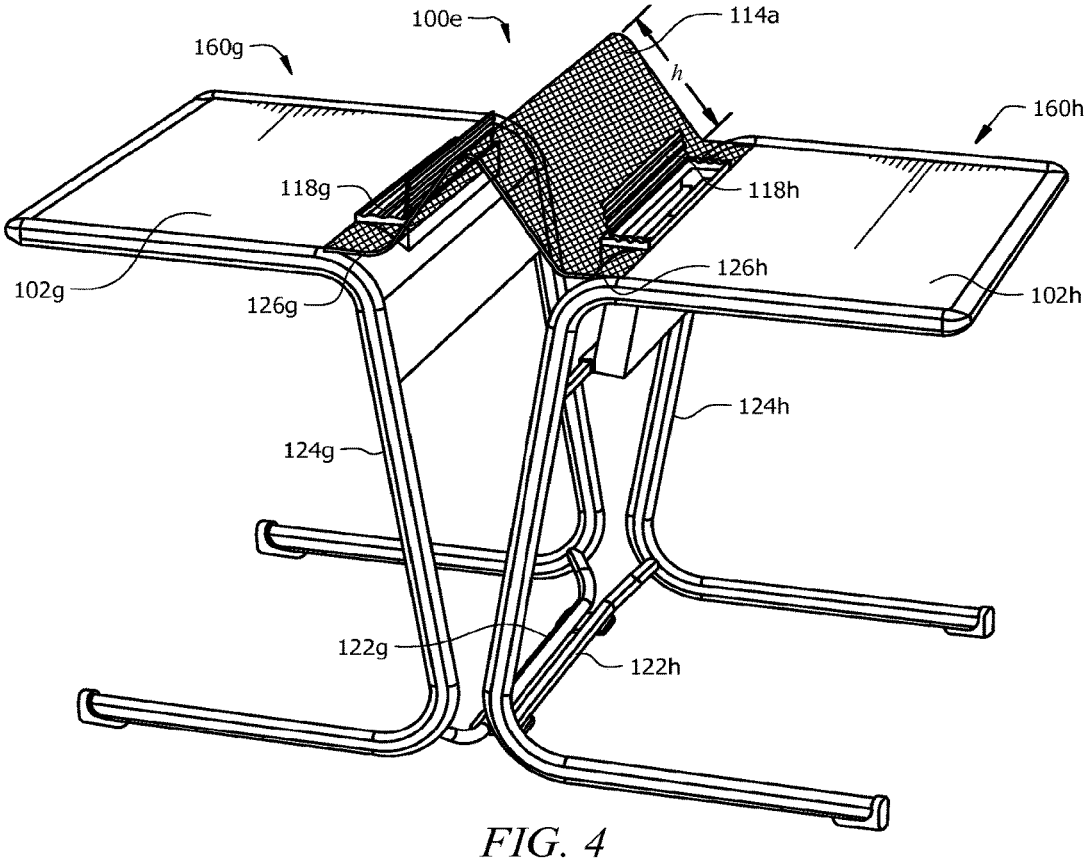
FIG. 4 is a perspective view of the system of modular desk components arranged in a fifth representative configuration according to embodiments of the present disclosure.

FIG. 4 is a perspective view of another representative configuration 100*e* of components of a modular desk system comprising a first assembly of modular components 160*g* (herein referred to as assembly 160*g*) and a second assembly of modular components 160*h* (herein referred to as assembly 160*h*), according to embodiments of the present disclosure.

Assembly 160*g* may include top panel 102*g*, desktop organization member 118*g* and kickstand base 122*g* coupled to support frame 124*g*. Assembly 160*h* may include top panel 102*h*, desktop organization member 118*h* and kickstand base 122*h* coupled to support frame 124*h*. Assemblies 160*g* and 160*h* may or may not be coupled according to embodiments of the present disclosure. In an embodiment where assemblies 160*g* and 160*h* are coupled, configuration 100*e* may include connecting divider 114*a* as shown in FIG. 4.

In an embodiment, each end of connecting divider 114*a* may be connected or otherwise coupled to support frame 124*g* and support frame 124*h*, respectively, in any suitable manner, such as, for example employing an s-hook to engage spine 126*g* of support frame 124*g* and spine 126*h* of support frame 124*h*, as shown in FIG. 4. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting divider 114*a* may comprise a wall having a height (h). Connecting divider 114*a* may be employed as privacy wall, a white board, a chalk board, a marker board, a bulletin board, a tack board, a magnet board, or any combination thereof. Connecting divider 114*a* may also be employed to house, retain or support a shelf, artwork, display case, photo support frame, television screen, liquid crystal display (LCD) screen, plasma screen, high definition television (HDTV) screen, projection television screen, computer screen, laptop, computer, central processing unit (CPU), monitor, terminal, video conferencing display, radio, other suitable devices, or any combination thereof.

Figure 5:
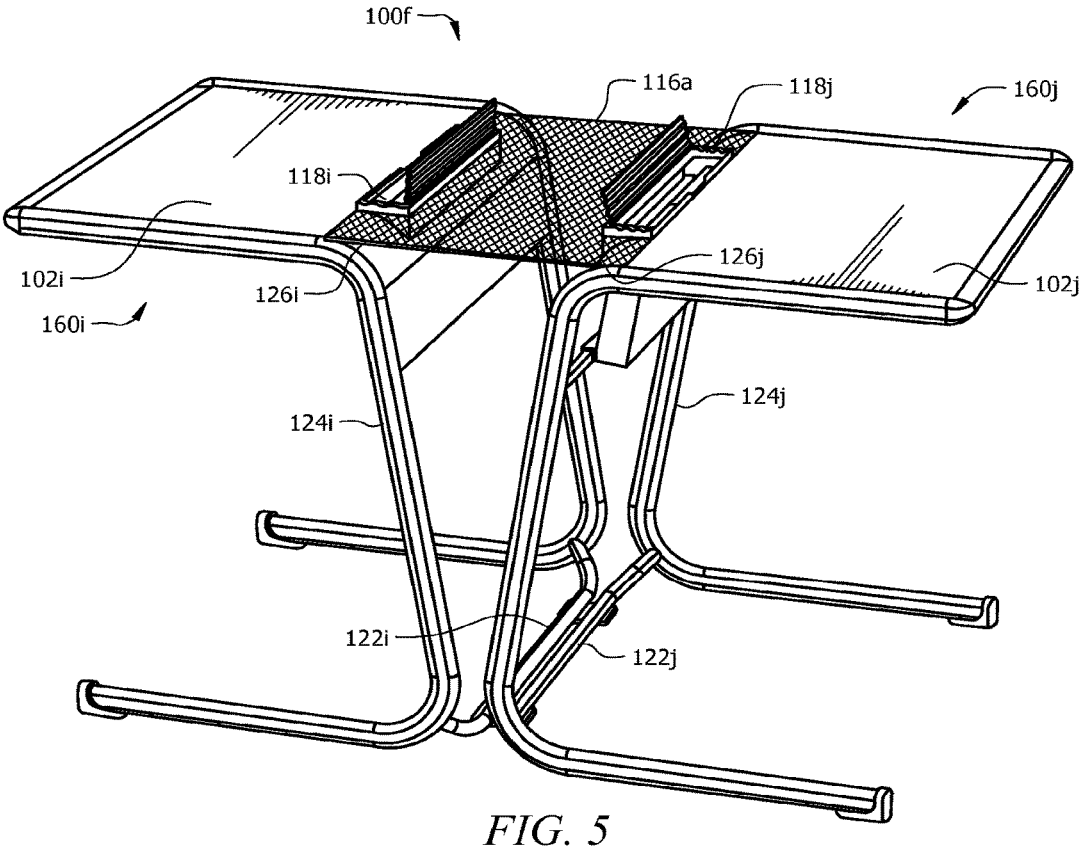
FIG. 5 is a perspective view of the system of modular desk components arranged in a sixth representative configuration according to embodiments of the present disclosure.

FIG. 5 is a perspective view of representative configuration 100*f* of components of a modular desk system comprising a first assembly of modular components 160*i* (herein referred to as assembly 160*i*) and a second assembly of modular components 160*j* (herein referred to as assembly 160*j*) according to embodiments of the present disclosure.

Assembly 160*i* may include top panel 102*i*, desktop organization member 118*i* and kickstand base 122*i* coupled to support frame 124*i*. Assembly 160*j* may include top panel 102*j*, desktop organization member 118*j* and kickstand base 122*j* coupled to support frame 124*j*. Assemblies 160*i* and 160*j* may or may not be coupled according to embodiments of the present disclosure. In an embodiment where assemblies 160*i* and 160*j* are coupled, configuration 100*f* may include connecting platform 116*a* as shown in FIG. 5.

In an embodiment, each end of connecting platform 116*a* may be connected or otherwise coupled to support frame 124*i* and support frame 124*j*, respectively, in any suitable manner, such as, for example employing an s-hook to engage spine 126*i* of support frame 124*i* and spine 126*j* of support frame 124*j*, as shown in FIG. 5. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting platform 116*a* may comprise a solid, flat surface. Connecting platform 116*a* may be employed as an additional writing surface, a workspace, a surface used in conjunction with educational study, a reading platform, a display platform, a media display and organization space, an organization platform, or any combination thereof. Connecting platform 116*a* may also be employed to house, retain or support a shelf, artwork, display case, photo support frame, television screen, liquid crystal display (LCD) screen, plasma screen, high definition television (HDTV) screen, projection television screen, computer screen, laptop, computer, central processing unit (CPU), monitor, terminal, video conferencing display, radio, other suitable devices, a white board, a chalk board, a marker board, a bulletin board, a tack board, a magnet board or any combination thereof.

In other embodiments, multiple other configurations of components of a modular desk system may be employed further demonstrating the flexibility and configurability of a modular desk system.

Figure 6A:
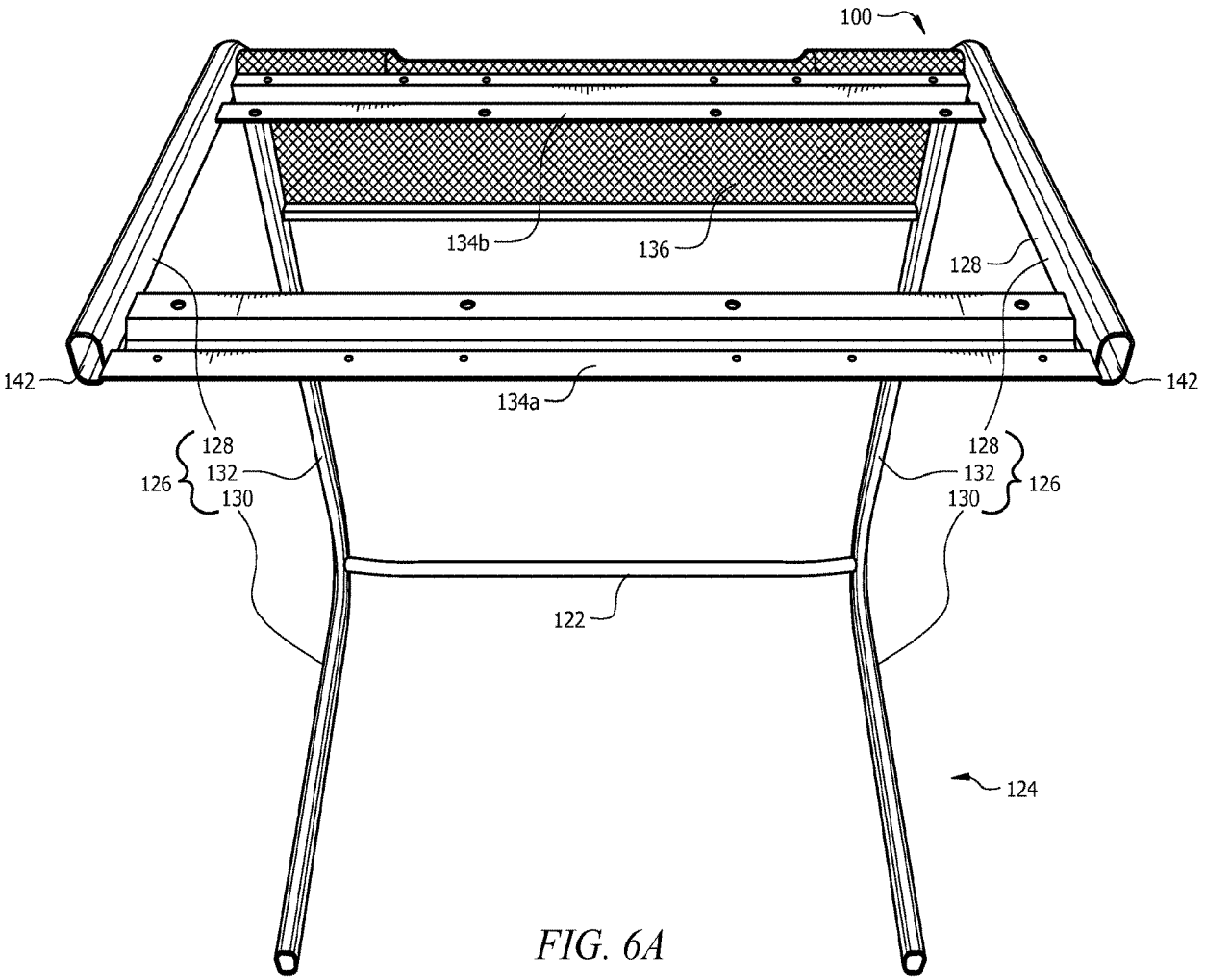
FIG. 6A is a perspective view of a representative support frame of the system of modular desk components according to embodiments of the present disclosure.
Figure 6B:
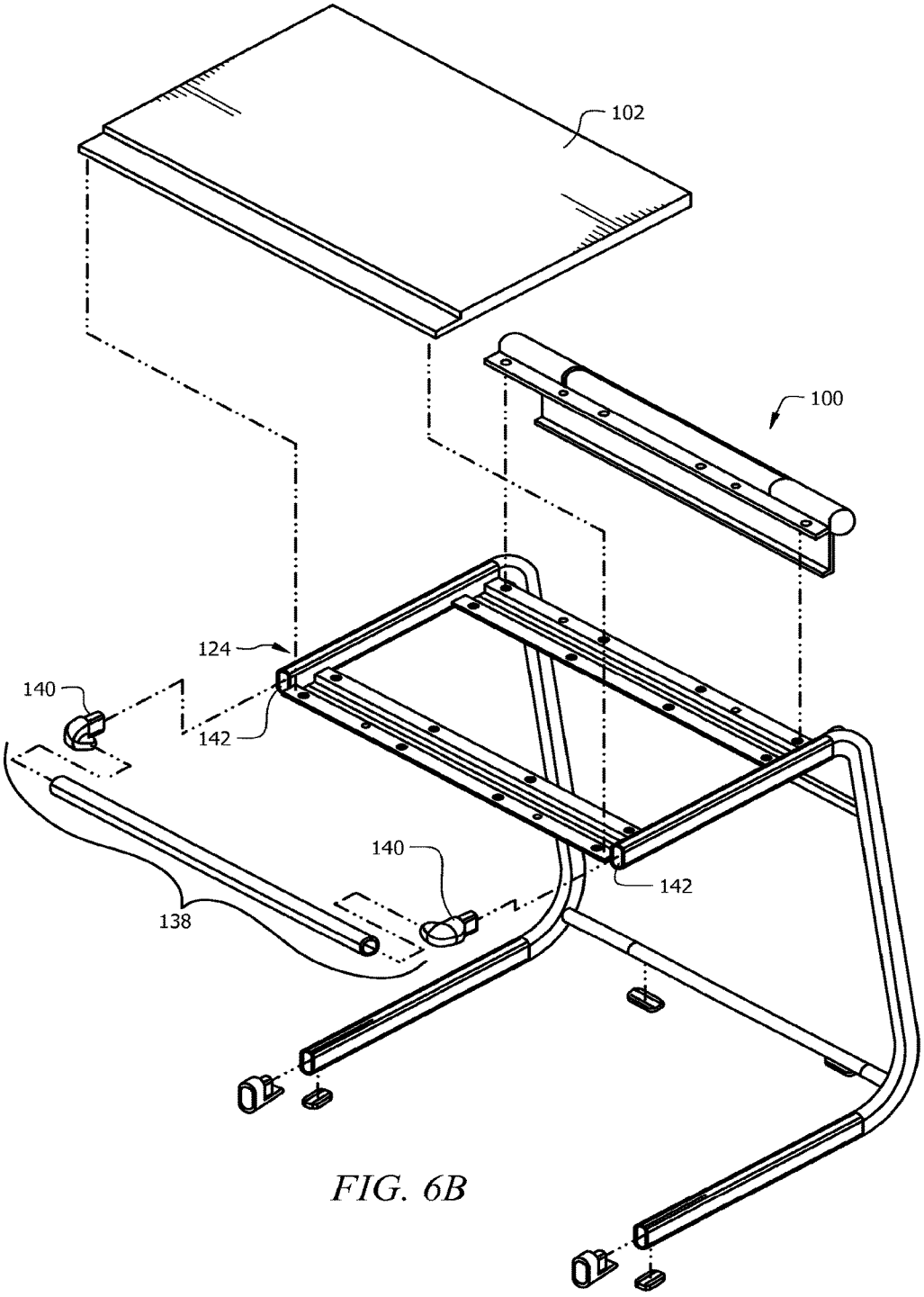
FIG. 6B provides an exploded view of a desk lip assembly connecting or coupling to the support frame shown in FIG. 6A according to embodiments of the present disclosure.
Figure 6C:
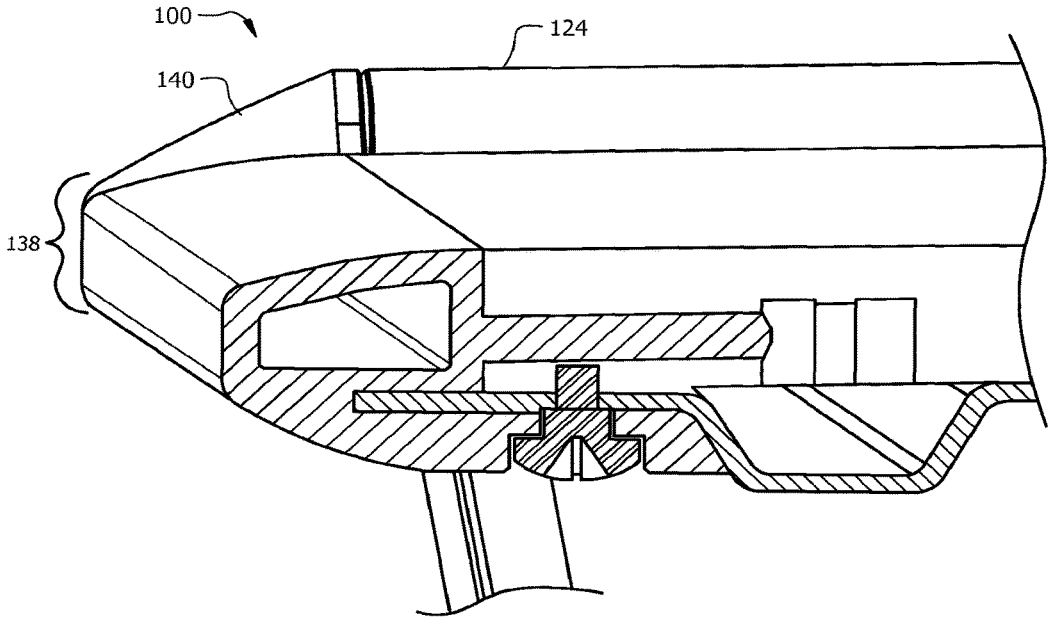
FIG. 6C provides a cross-sectional view of the desk lip assembly shown in FIG. 6B connected to or otherwise coupled to the support frame shown in FIG. 6A according to embodiments of the present disclosure.
Figure 6D:
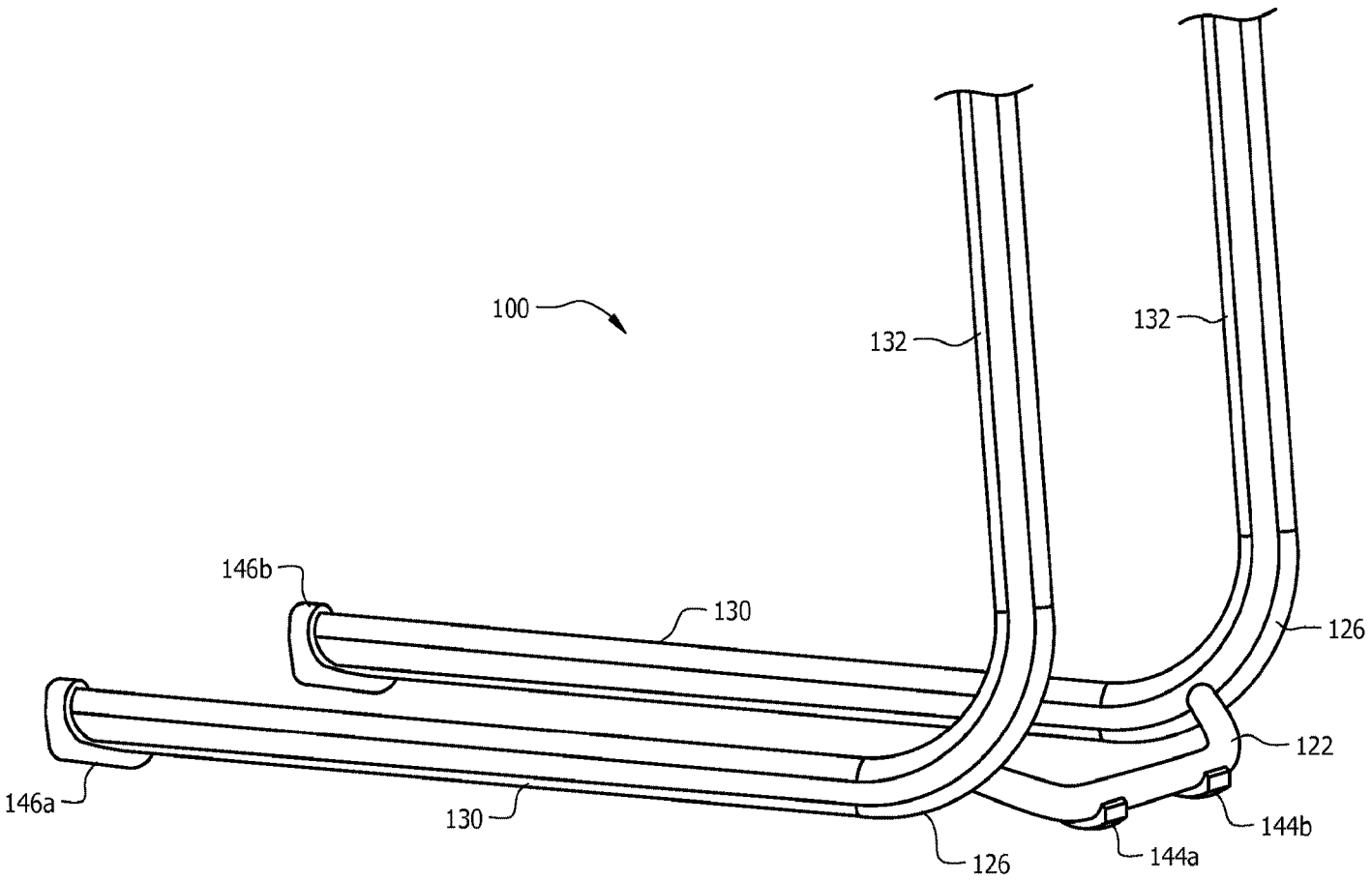
FIG. 6D is a perspective view of a representative kickstand base of the system of modular desk components connected or otherwise coupled to the support frame shown in FIG. 6A according to embodiments of the present disclosure.
Figure 7:
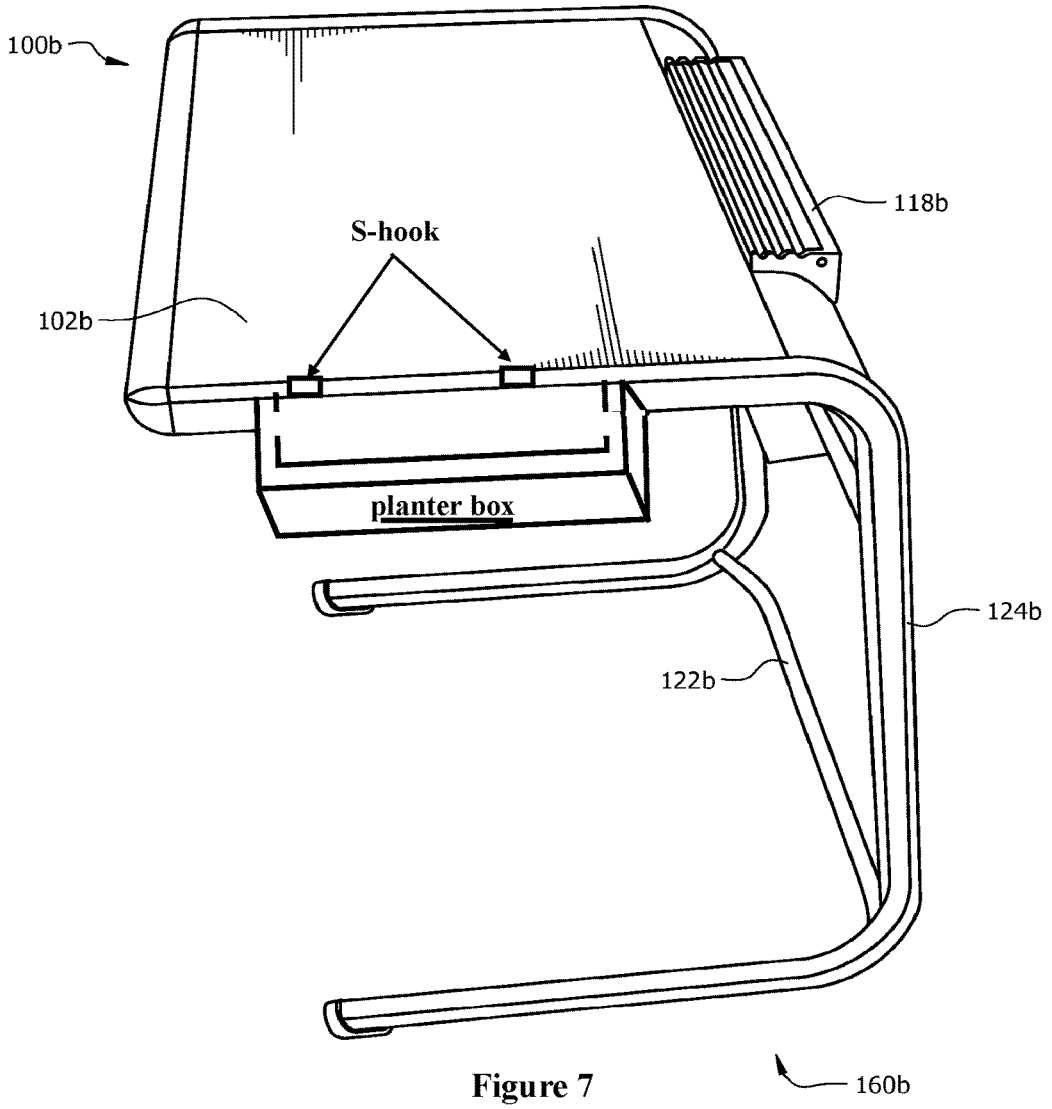
FIG. 7 illustrates an implementation of a desk with a plantar box.
Figure 8A:
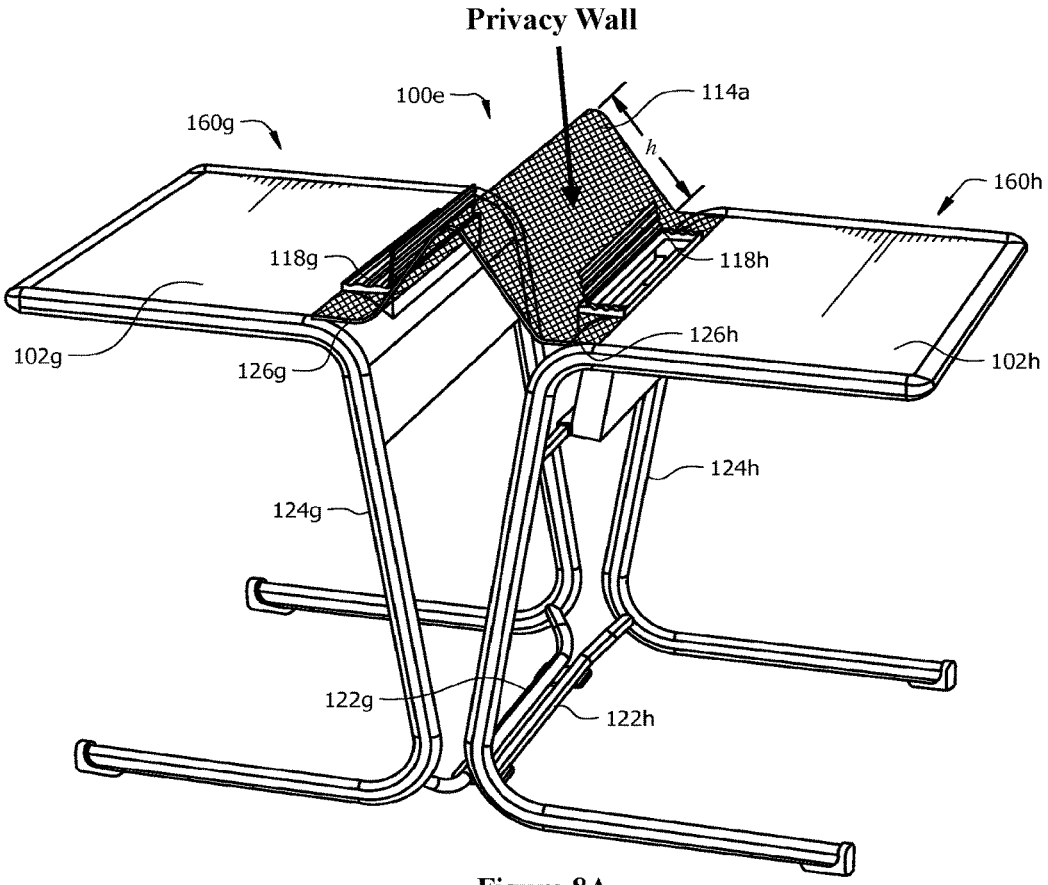
FIGS. 8A-8E illustrate implementations of desks that are connected with a connecting divider that includes a wall.
Figure 8B:
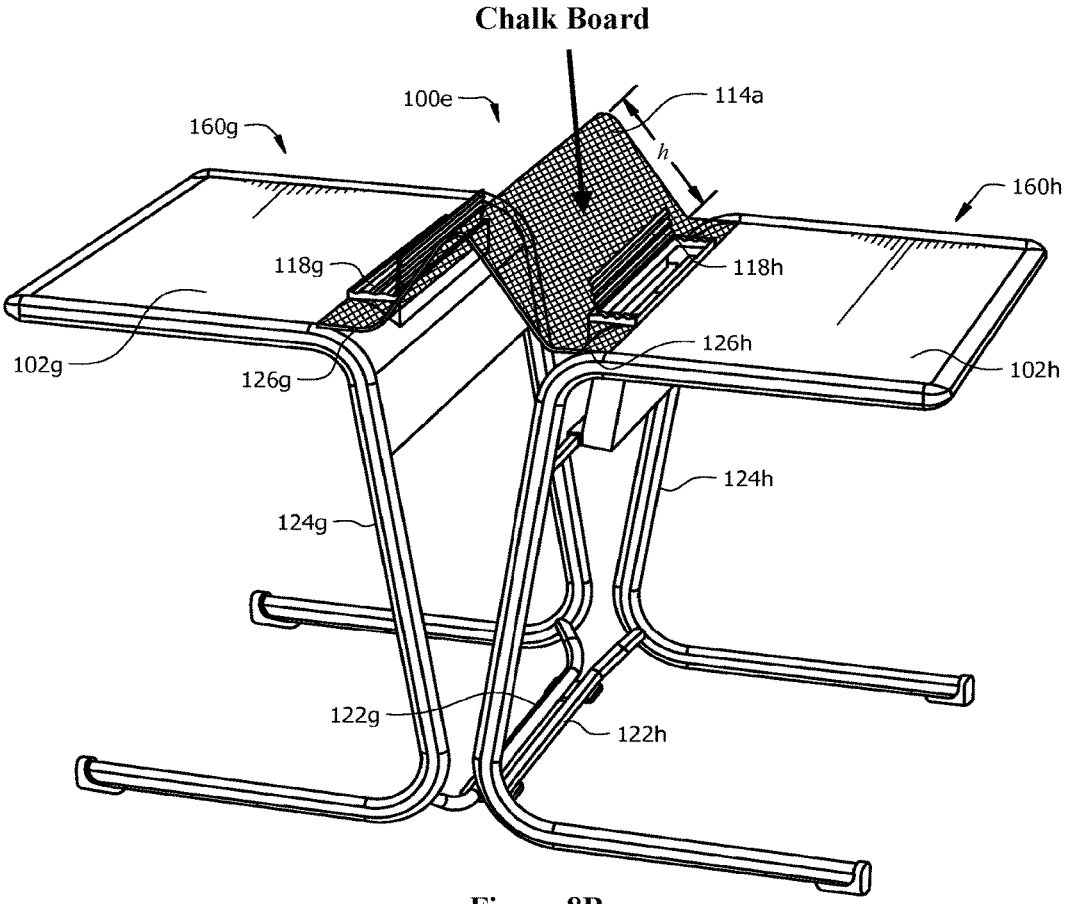
Figure 8C:
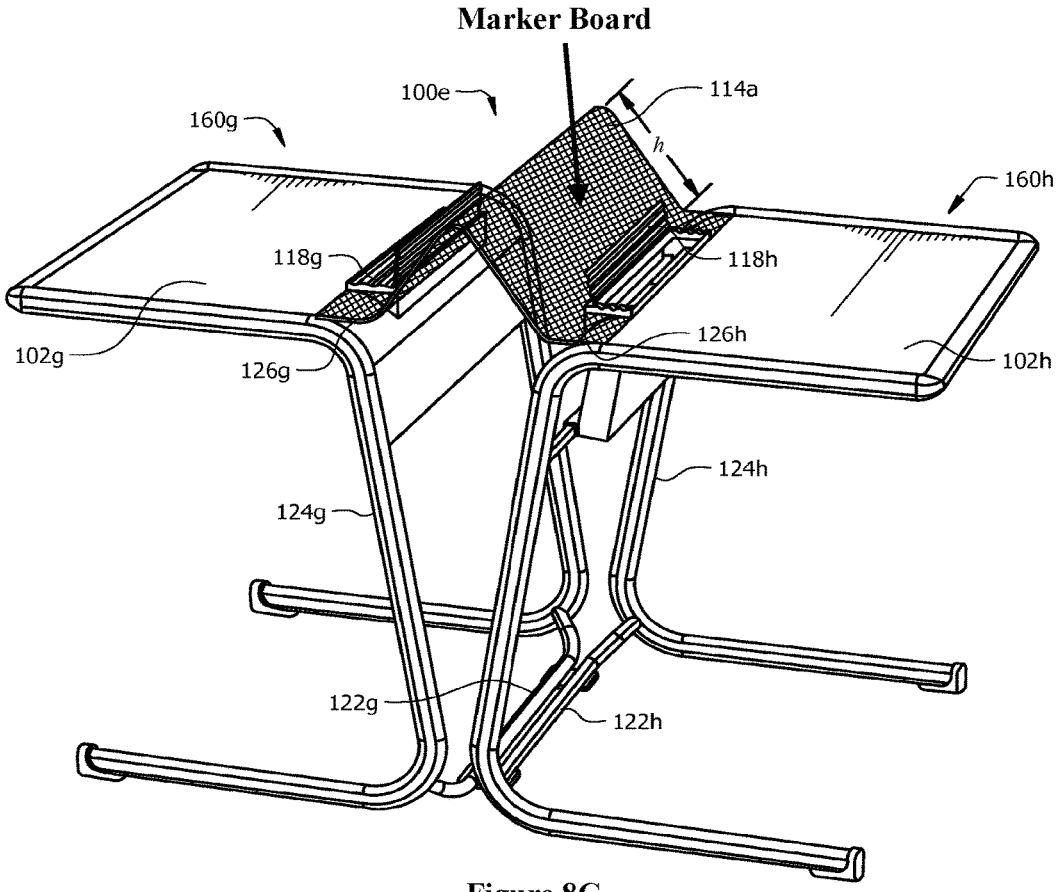
Figure 8D:
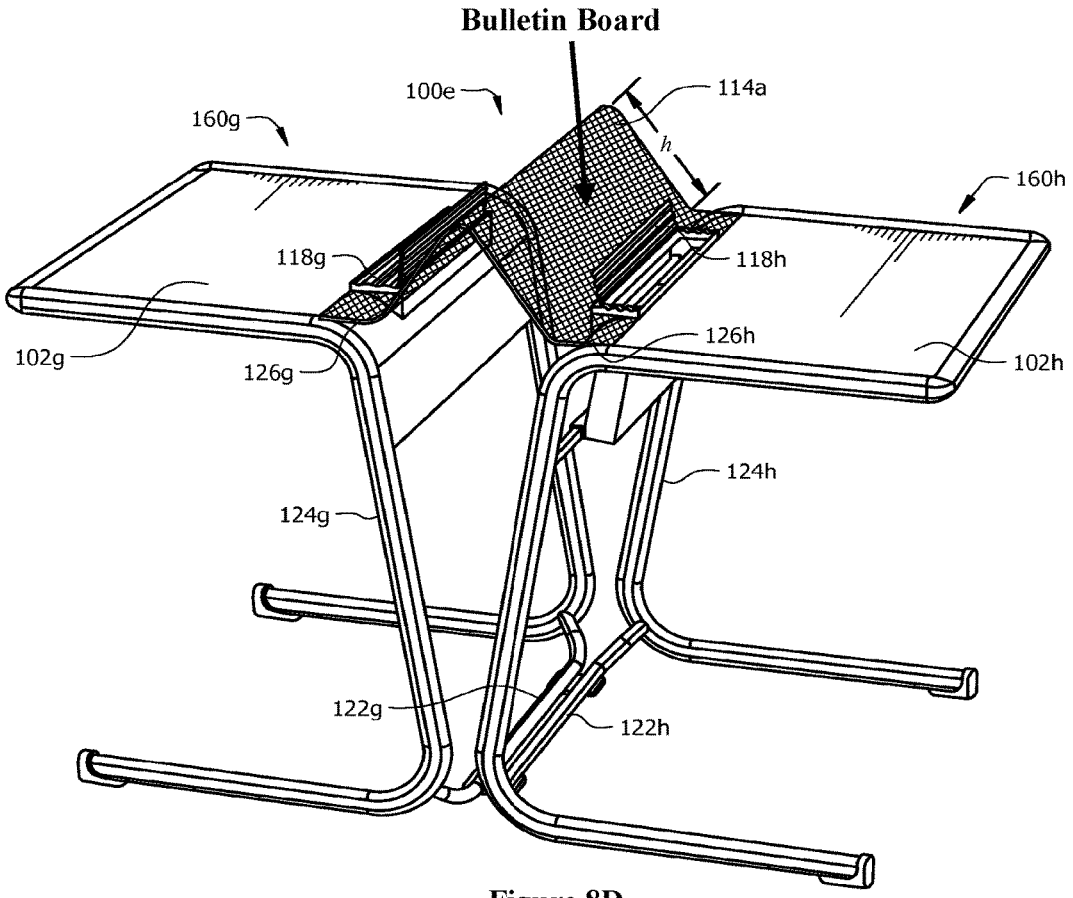
Figure 8E:
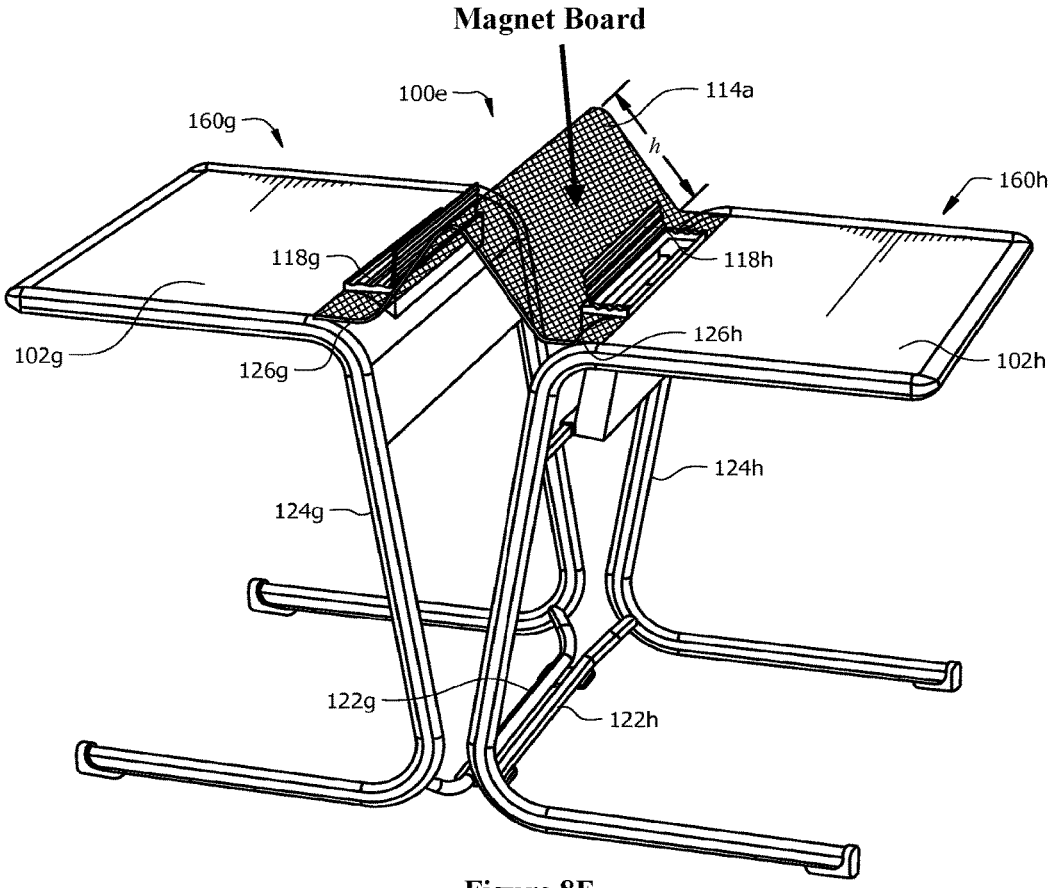
Figure 9A:
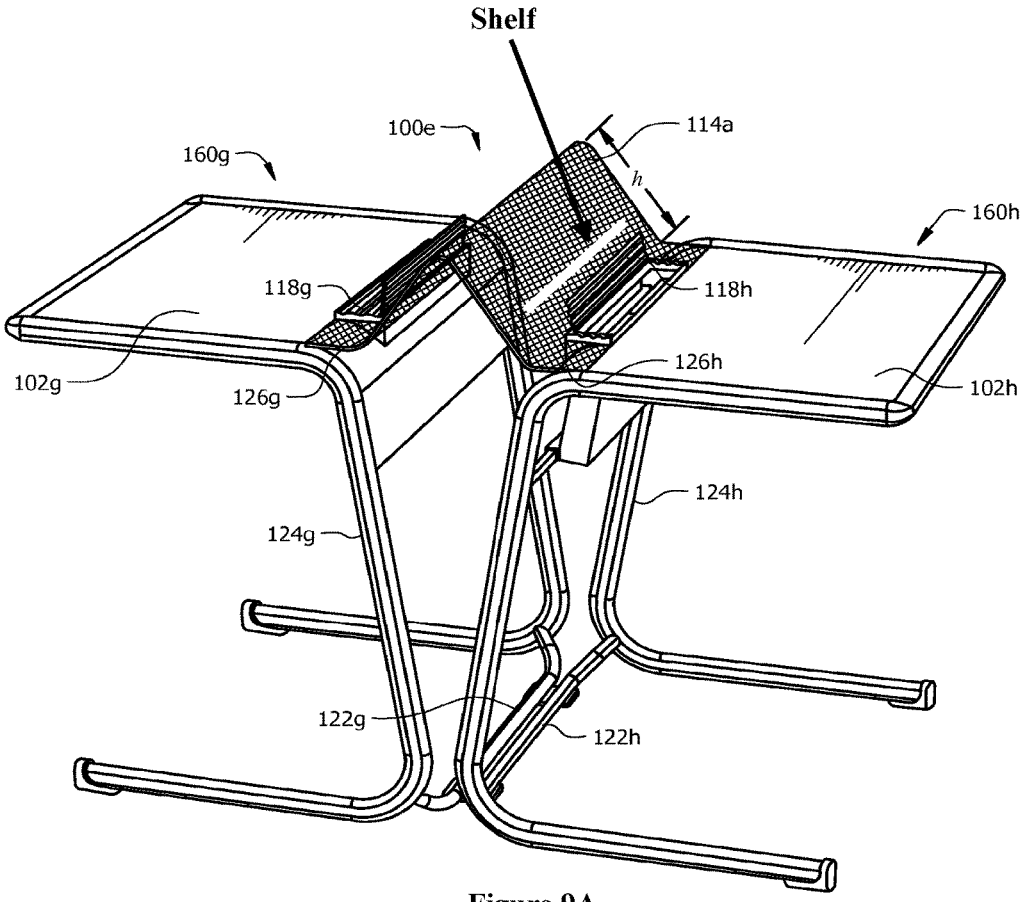
FIGS. 9A-9E illustrate implementations of desks that are connected with a connecting divider.
Figure 9B:
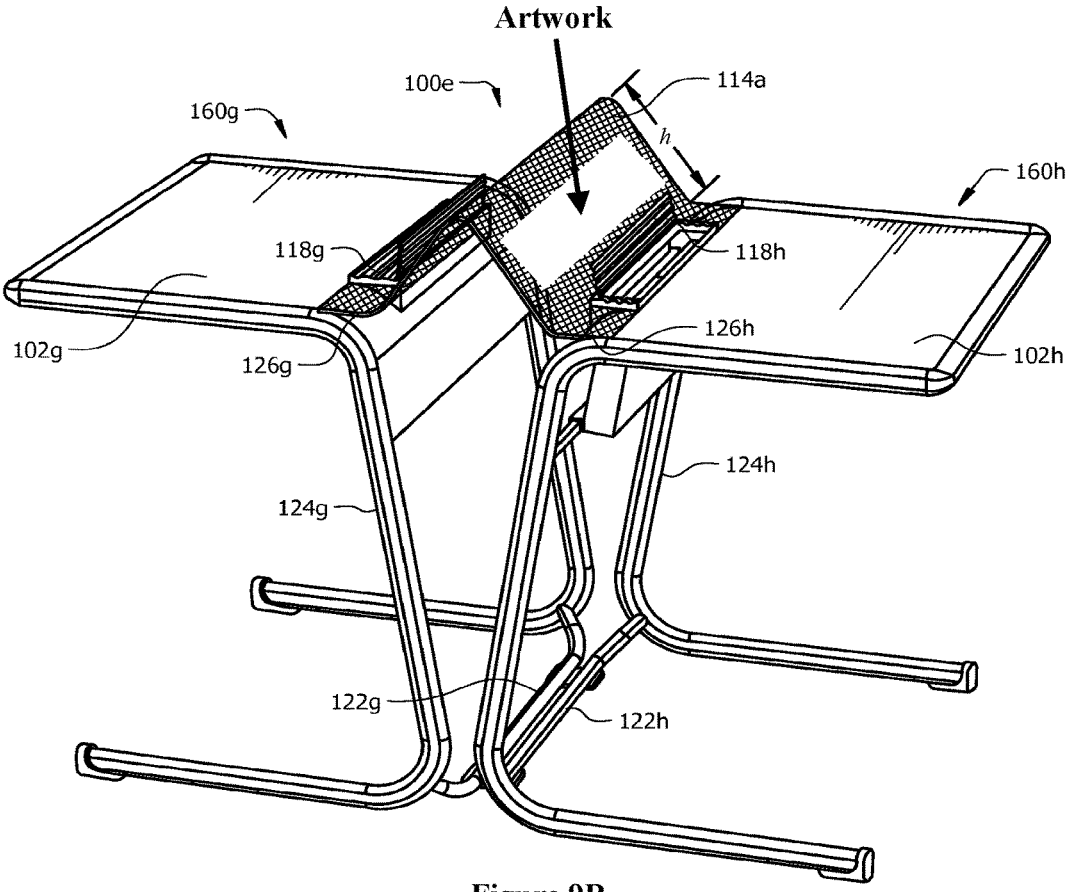
Figure 9C:
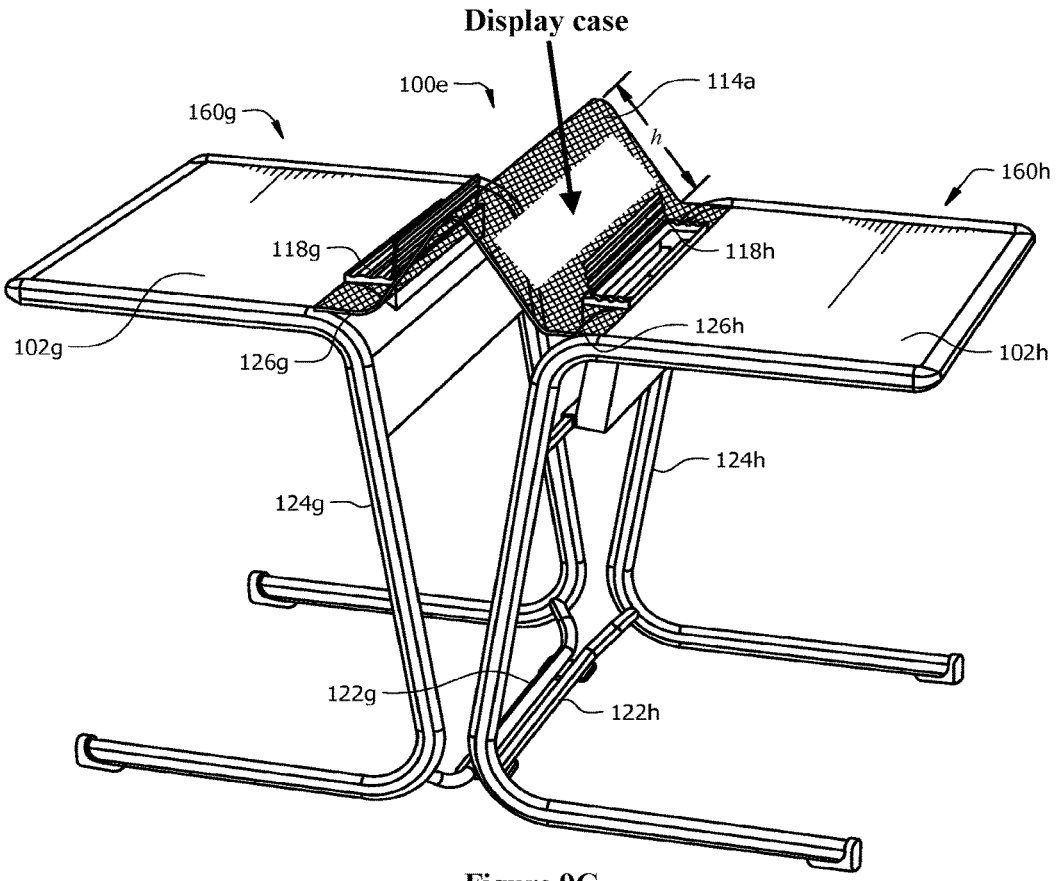
Figure 9D:
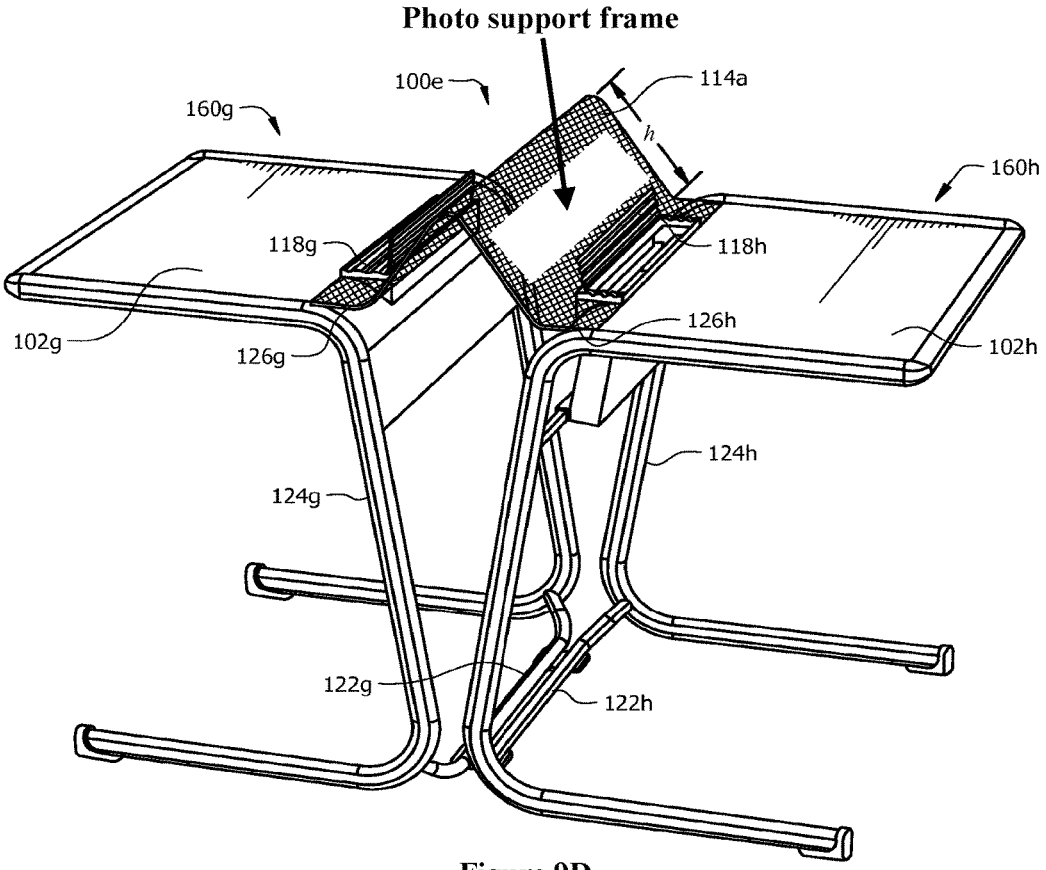
Figure 9E:
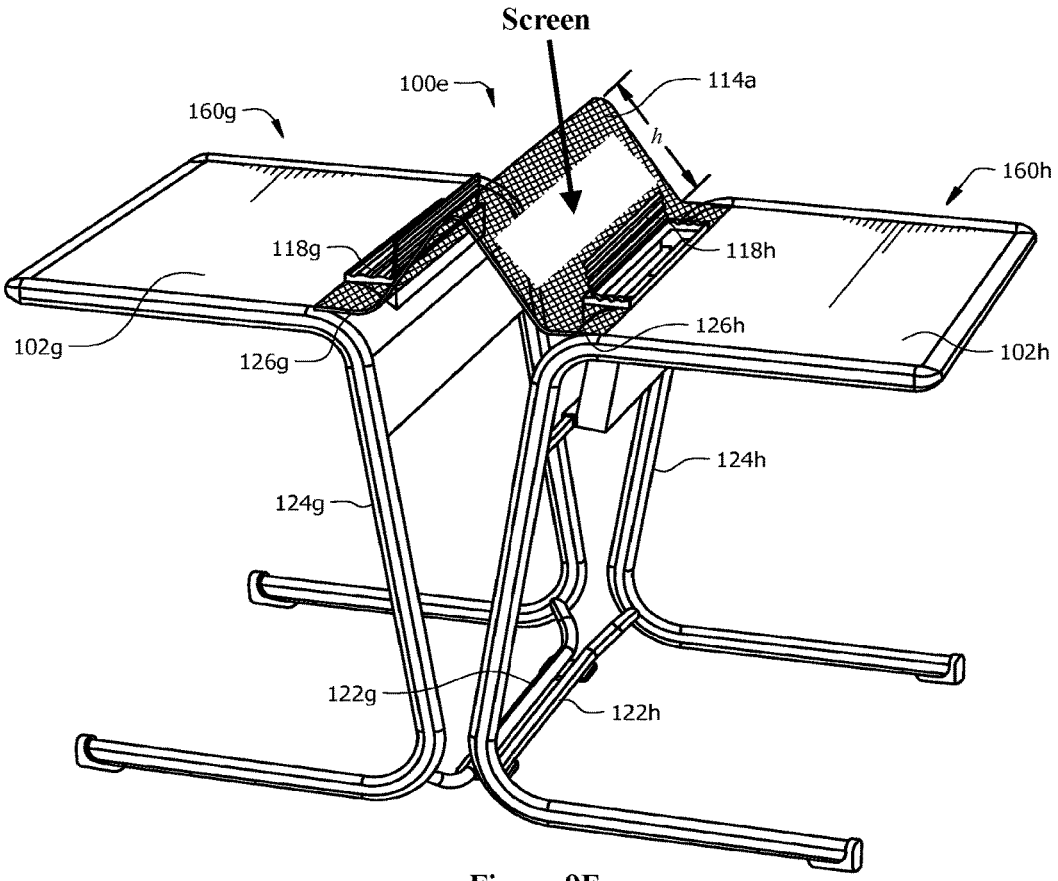

FIG. 6A generally illustrates support frame 124 that may be employed in configurations 100*a*, 100*b*, 100*c*, 100*d*, 100*e* and 100*f* of FIGS. 1-5 and other suitable configurations according to embodiments of the present disclosure. FIG. 6B provides an exploded view of a desk lip assembly 138 connected to or otherwise coupled to the support frame 124 of FIG. 6A. FIG. 6C provides a cross-sectional view of the desk lip assembly 138 connected to or otherwise coupled to the support frame 124 of FIG. 6A. FIG. 6D provides a perspective view of a kickstand base 122 connected to or otherwise coupled to the support frame 124 of FIG. 6A.

Support frame 124 may include a pair of C-shaped side support frame spines 126 connected or otherwise coupled via top panel supports 134*a* and 134*b*, back brace 136, and kickstand 122. Each side support frame spine 126 includes a top panel support section 128, base section 130 and vertical section 132 therebetween.

In an embodiment, top panel support section 128 and vertical section 132 may be employed as handles to lift, carry and arrange a modular desk system.

In embodiments of the present disclosure, top panel supports 134*a* and 134*b* may be connected or otherwise coupled to the bottom surface of top panel 102, as shown in FIG. 6B, in any suitable manner, such as, for example via male and female coupling adapters, a screw and socket attachment, a nut and bolt attachment, a clip or pin attachment, a ball and socket attachment, or other suitable connection or coupling mechanisms, or any combination thereof.

In embodiments of the present disclosure, top panel support sections 128 may be connected or otherwise coupled to the sides of top panel 102 in any suitable manner, such as, for example via male and female coupling adapters, a screw and socket attachment, a nut and bolt attachment, a clip or pin attachment, a ball and socket attachment, or other suitable connection or coupling mechanisms, or any combination thereof.

Top panel 102 may further be supported by back brace 136.

Desk lip assembly 138 may be employed to lock top panel 102 in place, while providing a leak proof seal to protect against liquid or solid spills from penetrating through a modular desk system, and thereby causing distress, morphing, buckling, or other similar states of wear.

In embodiments of the present disclosure, desk lip assembly 138 may be connected or otherwise coupled to support frame 124 in any suitable manner, such as, for example via male and female coupling adapters, which may include tabs 140 engaging slots 142 as shown in FIG. 6B. Such connections or couplings may be achieved in other suitable manners including a screw and socket attachment, a clip or pin attachment, a ball and socket attachment, or other suitable connection or coupling mechanisms, or any combination thereof.

Kickstand base 122 may be employed to provide solid structural integrity to a modular desk system 100. In embodiments of the present disclosure, kickstand base 122 connects or otherwise couples to spine 126 at the intersection of base section 130 and vertical section 132, as shown in FIG. 6C. The higher connection point between kickstand base 122 and spine 126 provides side stability for a modular desk system, while kickstand base 122 may be angled enough to provide sufficient push back when force is exerted against a modular desk system. In one embodiment, the width of kickstand base 122 may be wide enough to extensively engage the floor to create sufficient breadth to effectively prevent a modular desk system from tipping over.

Kickstand base 122 may also include stoppers 144*a* and 144*b* made of rubber or another resilient material with a high coefficient of friction such that when stoppers 144*a* and 144*b* engage the floor, stoppers 144*a* and 144*b* may further prevent modular desk system 100 from tipping over.

Optionally, footcaps 146*a* and 146*b* may be employed to further provide stability to system 100. The large surface area of footcaps 146*a* and 146*b* may engage the floor causing friction to effectively prevent modular desk system 100 from unintentionally tipping.

In embodiments of the present disclosure, any of top panel 102, storage shelf 108, connecting shelf 110, connecting planter box 112, connecting divider 114, and/or connecting platform 116 may be made of, composed of, coated with, layered with, or otherwise include, for example, laminate, veneer, wood, cork, medium density fiber (MDF) board, particle board, melamine, granite, solid surface, tile, ceramic tile, fiberglass, soap stone, engineering stone, marble, concrete, slate, wood, butcher block, glass, steel, stainless steel, aluminum, metal, mesh, apertured material, plastic, blackboard material, wipe-off board material, mirror, paint, lacquer, polypropylene, polyurethane, polyethylene, polyvinyl chloride (PVC), silicon, polytetrafluoroethylene (PTFE), polyester, high-gloss polyester, synthetic rubber, natural rubber, polymer, fabric, natural fiber, synthetic fiber, other suitable materials, or any combination thereof.

Any of all-purpose hook 104, cup hook 106, desktop organization member 118, channel 120, kickstand base 122, support frame 124, rails 126, top panel support section 128, base section 130, vertical section 132, top panel supports 134*a* and 134*b*, and/or back brace 136, may be made of, composed of, or otherwise include, for example, steel, aluminum, brass, bronze, stainless steel, another type of metal, wood, nylon, plastic, polyurethane, polyethylene, polyvinyl chloride (PVC), polytetrafluoroethylene (PTFE), polyester, high-gloss polyester, laminate, plexiglass, polymer, other suitable materials, or any combination thereof.

Any of all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may be made of synthetic rubber, natural rubber, plastic, wood, polyester, high-gloss polyester, laminate, plexiglass, polymer, metal, steel, aluminum, brass, bronze, nylon, other suitable materials, or any combination thereof.

In an embodiment, any of top panel 102, storage shelf 108, connecting shelf 110, connecting planter box 112, connecting divider 114, connecting platform 116, all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may include any number of suitable coatings and layers to substantially reduce scratching or injury to an object or electronic media device supported by or retained within a modular desk system, as well as to any surface engaged by a modular desk system.

In one embodiment, the coatings and layers applied to any of top panel 102, storage shelf 108, connecting shelf 110, connecting planter box 112, connecting divider 114, connecting platform 116, all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may be made of natural rubber, synthetic rubber, polymer, natural fiber, synthetic fiber, polyester, nylon, cotton, cotton mesh, vinyl, other suitable material, or any combination thereof.

In one embodiment, the coatings and layers applied to any of top panel 102, storage shelf 108, connecting shelf 110, connecting planter box 112, connecting divider 114, connecting platform 116, all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may be embellished with different colors, patterns, camouflage patterns, wood grain patterns, novelty items, ornamental items, stickers, removable stickers, paints, stencils, chalks, designs, images, other decorative materials, or any combination thereof to enhance or otherwise achieve the desired décor of the surroundings.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A modular desk assembly comprising:

a first linkable desk, wherein the first linkable desk comprises:

a first support frame, wherein the first support frame comprises a pair of first C-shaped spine members, wherein each first C-shaped spine members comprises:
a first section;
a second section; and
a third section vertically disposed between the first section and the second section, wherein the third section couples the first section and the second section;
a first table top coupled the first sections of the first C-shaped spine members;
one or more desktop organization members, wherein the desktop organization member comprises:
a top surface, wherein the top surface comprises ridges adapted to retain objects when the desktop organization member is in a closed position; and
a nest coupled to a housing of the desktop organization member, and wherein the nest is adapted to store objects;
wherein when the desktop organization member is in an open position, the top panel of the desktop organization member leans against a housing of the desktop organization member such that a top panel of the desktop organization member and a ledge member of a desktop organization member form a display stand;
and wherein the linkable desk is capable of indirectly coupling with one or more other linkable desks via a connection device, and wherein at least one of the first sections of the support frame of the linkable desk engages with the connection device to couple the linkable desk with the one or more other linkable desks, and wherein the at least one of the first sections of the support frame engages with the connection device such that a portion of the connection device contacts and couples with at least a portion of a top surface of at least a part of the first section of the first support frame.

2. The modular desk assembly of claim 1 wherein the first linkable desk comprises at least one of a storage shelf, an accessory hook, or a desktop organization member.

3. The modular desk assembly of claim 1 wherein the connection device comprises a planter box, and wherein a first end of the planter box is coupled to the first linkable desk via a first S-hook and wherein a second end of the planter box is coupled to one of the second linkable desks via a second S-hook.

4. The modular desk assembly of claim 1 further comprising one or more other connection devices, and wherein at least one of the other connection devices comprises a connecting shelf, and wherein a first end of the connecting shelf is coupled to the first linkable desk via a first S-hook and wherein a second end of the connecting shelf is couplable to a second linkable desk via a second S-hook.

5. The modular desk assembly of claim 1 wherein the connection device is operable as at least one of a writing surface, a workspace, a reading platform, a display platform, a media display and organization space, or organization space.

6. The modular desk assembly of claim 1 further comprising:
one or more second linkable desks, wherein each second linkable desk comprises:
a second support frame, wherein the second support frame comprises a pair of second C-shaped spine members, wherein each of the second C-shaped spine members comprises:
a first section;
a second section; and
a third section vertically disposed between the first section and the second section, wherein the third section couples the first section and the second section; and
a second table top coupled the first sections of the second C-shaped spine members; and
the connection device comprising a first end and an opposing second end; wherein the connection device is capable of coupling the first linkable desk to at least one of the second linkable desks by coupling at the first end to one of the first sections of the first support frame of the first linkable desk and by coupling at the second end to one of the first sections of the second support frame of the second linkable desk.

7. The modular desk assembly of claim 6 further comprising one or more third linkable desks, wherein each third linkable desk comprises:
a third support frame, wherein the third support frame comprises a pair of third C-shaped spine members, and wherein each of the third C-shaped spine members comprises:
a first section;
a second section; and
a third section vertically disposed between the first section and the second section, wherein the third section couples the first section and the second section; and
a third table top coupled the first sections of the third C-shaped spine members; and
a second connection device adapted to couple the third linkable desk to at least one of the first linkable desk or one of the second linkable desks.

8. The modular desk assembly of claim 6 wherein the second linkable desk comprises at least one of a storage shelf, an accessory hook, or a desktop organization member.

9. The modular desk assembly of claim 1 wherein the connection device comprises a flat surface.

10. The modular desk assembly of claim 1 wherein the first linkable desk further comprises a kickstand base, wherein the kickstand base couples the pair of C-shaped spine members, and wherein the kickstand base is disposed proximate the opposing second ends of the third sections of the C-shaped spine members.

11. The modular desk assembly of claim 1 wherein the first linkable desk further comprises a storage box disposed below the first table top.

12. A modular desk assembly comprising:
one or more linkable desks, wherein each linkable desk is capable of operating independently and capable of operating while linked to one or more other linkable desks, wherein each linkable desk comprises:
a support frame, wherein the support frame comprises a pair of C-shaped spine members, wherein each C-shaped spine members comprises:
a first section;
a second section; and
a third section vertically disposed between the first section and the second section, wherein the third section couples the first section and the second section;
a table top coupled to the first sections of each of the C-shaped spine members;
wherein one or more of the linkable desks further comprises a desktop organization member, and wherein the desktop organization member comprises:
a top surface, wherein the top surface comprises ridges adapted to retain objects when the desktop organization member is in a closed position;

a nest coupled to a housing of the desktop organization member, and wherein the nest is adapted to store objects;

wherein when the desktop organization member is in an open position, the top panel of the desktop organization member leans against a housing of the desktop organization member such that a top panel of the desktop organization member and a ledge member of a desktop organization member form a display stand;

and wherein the linkable desk is capable of indirectly coupling with one or more other linkable desks via a connection device, and wherein the support frame of the linkable desk engages with at least one S-hook of the connection device to couple the linkable desk to another linkable desk, and wherein the support frame engaging with the at least one S-hook comprises a surface of the support frame contacting and coupling with at least a portion of the at least one S-hook.

13. The modular desk assembly of claim 12 further comprising a kickstand base, wherein the kickstand base couples the pair of C-shaped spine members, and wherein the kickstand is disposed proximate the third sections of the C-shaped spine members.

14. The modular desk assembly of claim 12 wherein at least one of the linkable desks further comprises at least one of a storage shelf, an accessory hook, or a desktop organization member.

15. The modular desk assembly of claim 12 wherein the connection device comprises at least one of a connecting shelf, a connecting planter box, a connecting divider, or a connecting platform.

16. The modular desk assembly of claim 12 wherein the modular desk assembly comprises a plurality of desks coupled to at least one other desk.

17. A modular desk assembly comprising:

a first linkable desk, wherein the first linkable desk comprises:

a first support frame, wherein the first support frame comprises a pair of first C-shaped spine members, wherein each first C-shaped spine members comprises:

a first section;

a second section; and a third section vertically disposed between the first section and the second section, wherein the third section couples the first section and the second section, and wherein the third section comprises a first end proximate the first section and an opposing second end proximate the second section;

a first side of the first linkable desk proximate ends of the first sections and the section sections of the pair of first C-shaped spine members;

a second opposing side of the first linkable desk proximate the third sections of the pair of first C-shaped spine members;

a first table top coupled to the first sections of the first C-shaped spine members, and wherein the first table top comprises a first part that extends between the first sections of the C-shaped spine members and a second part that extends between at least a portion of the third sections of the C-shaped spine members;

a kickstand base, wherein the kickstand base couples the pair of C-shaped spine members, and wherein the kickstand base is disposed proximate the opposing second ends of the third sections of the C-shaped spine members;

and wherein the linkable desk is capable of indirectly coupling with one or more other linkable desks via one or more connection devices, wherein one or more of the connecting devices coupling the linkable desk with the one or more other linkable desks comprises at least one of a connecting platform or a plantar box, wherein the linkable desk is capable of coupling with one of the other linkable desks via a connecting platform extending between the second side of the linkable desk and a second side of the one or more other linkable desks such that a top surface of the first part of the first table top proximate the second side of the linkable desk is approximately planar with at least a first portion of the top surface of the connecting platform, and wherein at least a second portion of the connecting platform is approximately planar with a top surface of the second side of the one of the other linkable desks, and wherein the linkable desk is capable of coupling with the one of the linkable desks via a planter box, and wherein a first end of the planter box is coupled to the linkable desk via a first S-hook and wherein a second end of the planter box is coupled to the one of the other linkable desks via a second S-hook, and wherein the first section of the support frame of the linkable desk engages with the first S-hook of the plantar connection device such that a portion of the first S-hook fits at least partially over a top surface of at least a part of the first section.

18. The modular desk assembly of claim 17 further comprising one or more desktop organization members, wherein the desktop organization member comprises:

a top surface, wherein the top surface comprises ridges adapted to retain objects when the desktop organization member is in a closed position; and a nest coupled to a housing of the desktop organization member, and wherein the nest is adapted to store objects;

wherein when the desktop organization member is in an open position, the top panel of the desktop organization member leans against a housing of the desktop organization member such that a top panel of the desktop organization member and a ledge member of a desktop organization member form a display stand.

19. The modular desk assembly of claim 17 further comprising a connecting divider, wherein the connecting divider couples with the support frame of the linkable desk, and wherein the connecting divider comprises a wall, and wherein the wall is operable as at least one of a privacy wall, a chalk board, a marker board, a bulletin board, or a magnet board.

20. The modular desk assembly of claim 17 wherein the connecting platform comprises a connecting divider, wherein the connecting divider comprises one or more walls extending higher than the first table top.

21. The modular desk assembly of claim 17 wherein the connection device is operable as at least one of:

a writing surface, a workspace, a reading platform, a di splay platform, wall operable to support a shelf, wall operable to support artwork, wall operable to support a display case, wall operable to support a photo support frame, wall operable to support a screen, a media display and organization space, or organization space.

* * * * *